US008251342B1

(12) United States Patent
Weiner

(10) Patent No.: US 8,251,342 B1
(45) Date of Patent: Aug. 28, 2012

(54) SPORTS BOARD HOLDER

(76) Inventor: David Carl Weiner, San Diego, CA (US)

( * ) Notice: Subject to any disclaimer, the term of this patent is extended or adjusted under 35 U.S.C. 154(b) by 466 days.

(21) Appl. No.: 12/506,916

(22) Filed: Jul. 21, 2009

Related U.S. Application Data

(60) Provisional application No. 61/084,902, filed on Jul. 30, 2008.

(51) Int. Cl.
*A47G 29/00* (2006.01)

(52) U.S. Cl. ..... 248/690; 248/692; 248/317; 248/339; 211/87.01; 211/86.01; 211/85.7; 211/71.01; 211/106.01; 280/825

(58) Field of Classification Search ..... 248/201, 248/309.1, 304, 305, 682, 690, 692, 317, 248/339; 211/13, 87, 87.01, 86.01, 85.7, 211/71.01, 106.01, 18, 66, 70.6, 94.01, 89; 36/15, 100; 280/841, 825; 294/163, 165
See application file for complete search history.

(56) References Cited

U.S. PATENT DOCUMENTS

| | | | | |
|---|---|---|---|---|
| 2,472,058 | A | 6/1949 | Artley | |
| 2,661,098 | A | 12/1953 | Wannop | |
| 2,805,777 | A | 9/1957 | Larson | |
| 3,693,923 | A | 9/1972 | Ayoub et al. | |
| 4,364,187 | A * | 12/1982 | Melendez | 36/15 |
| 4,364,487 | A * | 12/1982 | Drumare | 220/89.3 |
| 5,120,012 | A * | 6/1992 | Rosenau | 248/201 |
| D334,316 | S | 3/1993 | Daniel | |
| 5,246,195 | A | 9/1993 | Huff | |
| 5,301,818 | A * | 4/1994 | Dix | 211/85.7 |
| 5,303,828 | A | 4/1994 | Paullin | |
| 5,305,897 | A * | 4/1994 | Smith | 211/85.7 |
| 5,755,414 | A * | 5/1998 | Remmers | 248/201 |
| 5,848,783 | A | 12/1998 | Weissenborn | |
| 6,293,412 | B1 * | 9/2001 | Draper | 211/4 |
| 6,585,209 | B1 | 7/2003 | Mattingly | |
| 6,634,687 | B1 * | 10/2003 | Hayes | 294/143 |
| 7,014,052 | B2 * | 3/2006 | Dettorre et al. | 211/85.7 |
| 7,395,842 | B2 | 7/2008 | Dyer | |

FOREIGN PATENT DOCUMENTS

| | | | |
|---|---|---|---|
| GB | 2090129 | A | 7/1982 |

OTHER PUBLICATIONS http://www.razrrak.com/razrrak.shtml, product description, Oct. 24, 2005, 1 page.

* cited by examiner

*Primary Examiner* — Todd M Epps
(74) *Attorney, Agent, or Firm* — Stephen C. Beuerle; Procopio Cory Hargreaves & Savitch LLP

(57) ABSTRACT

An aspect of the invention involves a wheeled sports board holder for hanging a wheeled sports board on a vertical surface, the wheeled sports board including a support deck with an upper portion supported by one or more upper wheels, and having an upper edge, and a lower portion supported by one or more lower wheels. The wheeled sports board holder includes a base with a front and a rear, the rear of the base mountable to the vertical surface; a wheel holder projecting forwardly relative to the front of the base, and having a wheel guide; and a clasp projecting forwardly relative to the front of the base, above the wheel holder, the clasp configured to hold the upper edge of the wheeled sports board towards the vertical surface so that the one or more lower wheels do not contact the vertical surface.

16 Claims, 4 Drawing Sheets

10
65
60
50
40
42
30
65

4
4
65
60
50
44
20
40
46
42
30

SPORTS BOARD HOLDER

RELATED APPLICATION

The present application claims the benefit of co-pending U.S. provisional patent application No. 61/084,902 filed Jul. 30, 2008, which is incorporated herein by reference in its entirety.

BACKGROUND

1. Field of the Invention

The present invention relates to storage devices for wheeled sports boards.

2. Related Art

Caster boards and skateboards, like scooters and bicycles, are a popular recreational toy, and like these other outside toys are typically stored in home garages, play rooms, patios, porches, yards, and other multi-purpose spaces in and around the home. Like these other toys, caster boards and skateboards are somewhat awkwardly shaped and are not well suited to more typical and readily available means of storage, and in most cases are left by users on the floor where they can be a safety hazard and another form of clutter. Specialty storage devices for these other toys and even skateboards are now readily available to users. However, there are currently no storage devices available in the market place suited to storing caster boards.

In addition, caster boards and skateboards are becoming more customized with all sorts of unique surface art and designs being offered. Consumers are using these designs to express their own personal tastes and style. Skateboard holders in the past store the skateboards, but do not ideally hold the skateboards so that the unique surface art and designs are shown off while the skateboards are being stored.

Further, caster board and skateboard accessories such as helmets and pads are also used and, therefore, also need to be stored. These accessories are also becoming more fashionable with customized art and designs appealing to consumer sense of taste and style. Skateboard holders in the past did not act as a single storage and display device for a user's board and accessories.

Known approaches to storing skateboards, bikes, and scooters generally allow other parts of these toys to make contact with the wall or vertical surface to which the storage device is attached. This can cause minor to moderate damage to these surfaces and, at the very least, can leave unsightly stains where toys once hung.

SUMMARY

The present invention involves a board holder that allows caster board users as well as skateboard users to hang their caster boards and skateboards neatly and safely on any wall or other vertical surface. The invention in one variation is best suited for caster boards, and in another variation is best suited for skateboards with the primary difference being the size and shape of a wheel guide and wheel holder of the invention. The invention also provides a way to not only store caster boards and skateboards, but also to display them so that unique surface art and designs on the boards can be shown off even when the boards are not in use. The invention acts as a single storage and display device for a user's board and accessories. Rather than just throwing these items on the garage floor, the invention provides user's with a way to display these items on the wall of a garage, play room, or even bedroom. Caster board and skateboard retailers can also use the device for their in-store product displays. Another unique feature of the invention is a clasp that keeps the lower wheel(s) of the caster board/skateboard away from the wall or other vertical surface to prevent the wheels from marking up or damaging the wall. Thus, the board holder includes a clasp, wheel guide, and wheel holder that work in conjunction to hold caster boards and skateboards vertically so that board surfaces are displayed as though they were works of art, and at the same time keeps the lower wheels off the wall and provides additional storage and display opportunities for accessories.

Another aspect of the invention involves a wheeled sports board holder for hanging a wheeled sports board on a vertical surface, the wheeled sports board including a support deck with an upper portion supported by one or more upper wheels, and having an upper edge, and a lower portion supported by one or more lower wheels. The wheeled sports board holder includes a base with a front and a rear, the rear of the base mountable to the vertical surface; a wheel holder projecting forwardly relative to the front of the base, and having a wheel guide; and a clasp projecting forwardly relative to the front of the base, above the wheel holder, the clasp configured to hold the upper edge of the wheeled sports board towards the vertical surface so that the one or more lower wheels do not contact the vertical surface.

One or more implementations of the wheeled sports board holder described immediately above include one or more of the following: the wheeled sports board is a caster board; the wheeled sports board is a skateboard; the wheeled sports board is a scooter; the wheeled sports board holder is a single storage and display device for the wheeled sports board; the wheeled sports board holder is an in-store product display; the wheeled sports board holder further includes an accessory carrier projecting forwardly relative to the front of the base and configured to carry one or more accessories associated with the wheeled sports board; at least one of the wheel holder and the clasp are adjustable to accommodate at least one of different types of wheeled sports boards and different sizes of wheeled sports boards; and the wheel guide includes a U-shape cross-section and concave inside surfaces that matingly receive the one or more upper wheels.

A further aspect of the invention involves a method of using the wheeled sports board holder described in the aspect of the invention described above. The method includes the steps of raising a vertically inclined wheeled sport board with its one or more upper wheels and one or more lower wheels facing the wheeled sports board holder; placing the one or more upper wheels into the wheel guide and rolling the one or more upper wheels up and over the wheel guide and down and into the wheel holder; and snapping the clasp over the upper edge of the wheeled sports board to secure the upper portion of the wheeled sports board into the wheeled sports board holder so that the one or more lower wheels do not contact the vertical surface.

One or more implementations of the method described immediately above include one or more of the following: the support deck of the wheeled sports board includes a substantially flat section, and the wheeled sports board holder secures the wheeled sports board in a position where the substantially flat section of the support deck is parallel with the vertical surface; and the support deck includes a top surface that includes artwork, and the wheeled sports board holder holding the wheeled sports board so that the artwork of the top surface of the support deck faces away from the vertical surface, so that the top surface is displayed as a work of art.

A further aspect of the invention involves a method of using the wheeled sports board holder described in the aspect of the invention described above. The method includes the steps of raising a vertically inclined wheeled sport board with its one or more upper wheels and one or more lower wheels facing the wheeled sports board holder; hooking the upper edge of the board behind the clasp; and pushing the lower portion of the wheeled sports board towards the vertical surface so as to force the one or more upper wheels into the wheel guide and then up and over into the wheel holder so as to secure the upper portion of the wheeled sports board into the wheeled sports board holder so that the one or more lower wheels do not contact the vertical surface.

One or more implementations of the method described immediately above include one or more of the following: the support deck of the wheeled sports board includes a substantially flat section, and the wheeled sports board holder secures the wheeled sports board in a position where the substantially flat section of the support deck is parallel with the vertical surface; and the support deck includes a top surface that includes artwork, and the wheeled sports board holder holding the wheeled sports board so that the artwork of the top surface of the support deck faces.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 1:
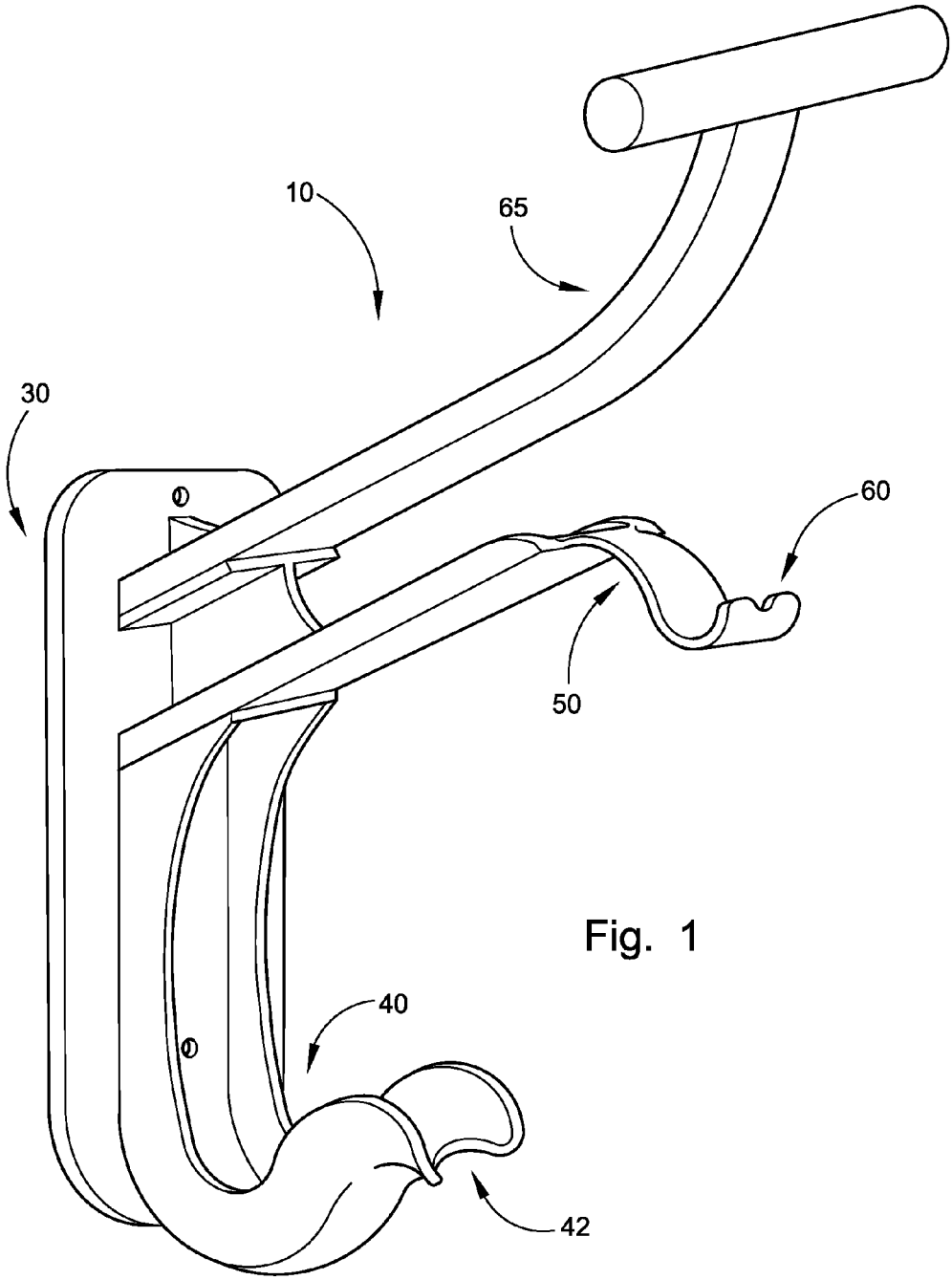
FIG. 1 is a perspective view of an embodiment of a board holder.
Figures 2, 3, 4:
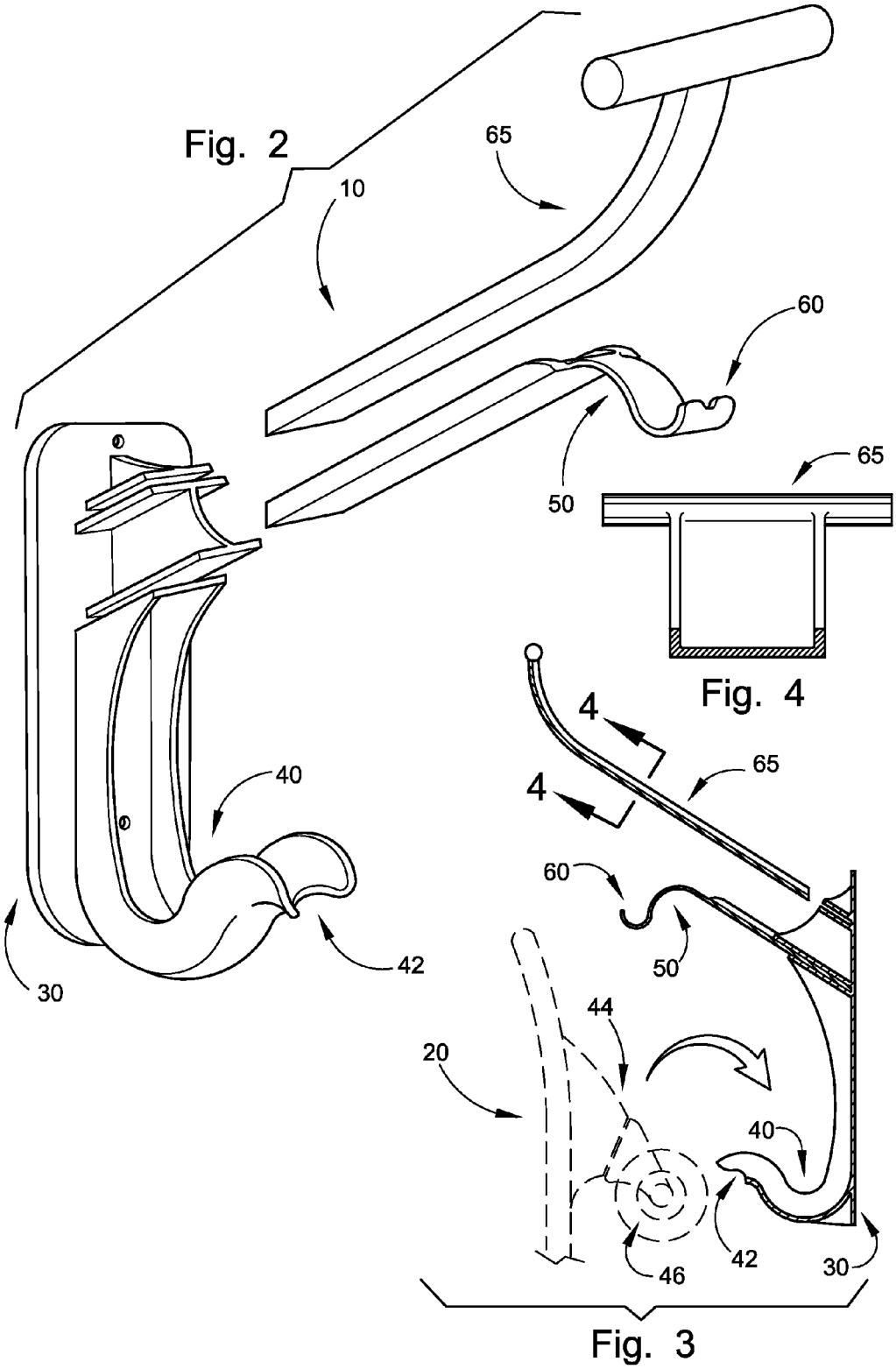
FIG. 2 is an exploded perspective view of the board holder of FIG. 1.
FIG. 3 is a side-elevational view of the board holder of FIG. 1 and shows an embodiment of a caster board just prior to mounting the caster board into the board holder.
FIG. 4 is a cross section of a helmet/accessory carrier of the board holder taken along lines 4-4 of FIG. 1.
Figure 9:
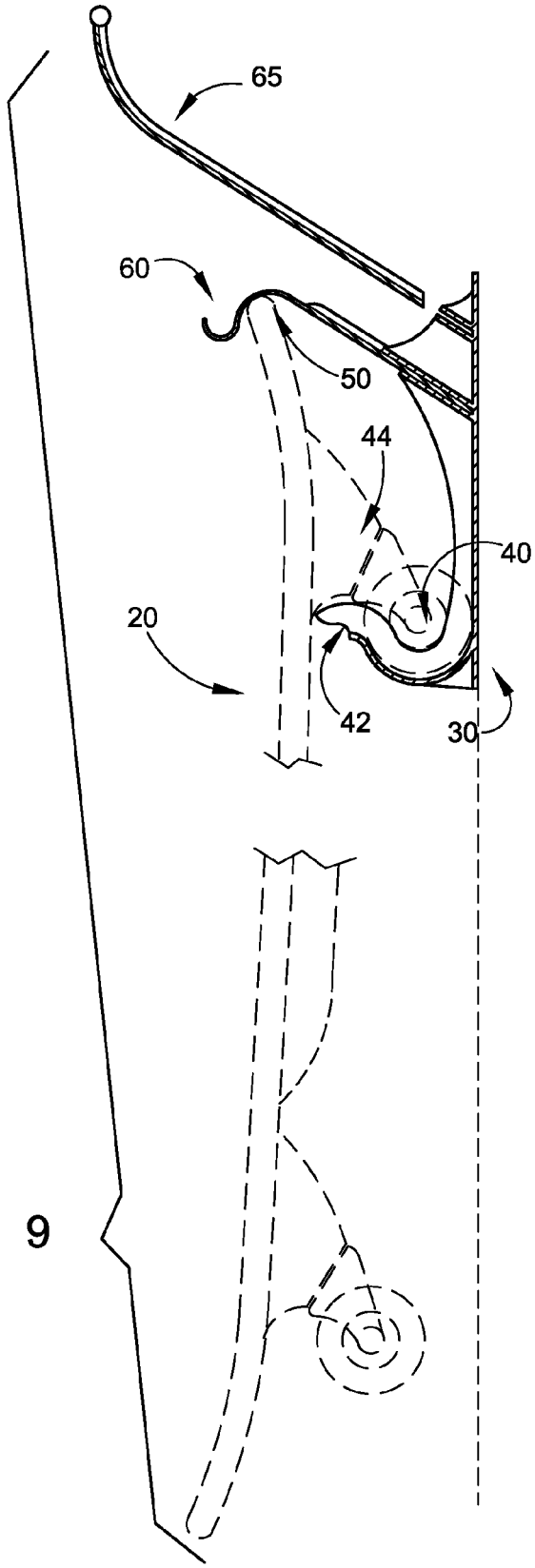
FIG. 9 is a side-elevational view of the board holder of FIG. 1 and shows the caster board being supportably held in the board holder.

With reference to FIGS. 1-4 and 9, an embodiment of a wheeled sports board holder ("board holder") 10 for supportably holding a wheeled sports board (e.g., caster boards, skateboards, and similar-type devices) vertically so that board surfaces are displayed as though they were works of art, and at the same time keeps the lower wheels off the wall and provides additional storage and display opportunities for accessories, will be described. Although the board holder 10 will be shown and described in conjunction with a caster board 20, in alternative embodiments, the holder 10 is used to hold skateboards, scooters (e.g., Razor® brand scooter), and/or similar wheeled devices with a support board/deck (i.e., wheeled sports boards).

The board holder 10 includes a base 30 that holds the other key components of the board holder 10 together, and allows for the board holder 10 to be mounted against a wall or other vertical surface by placing its rear facing surface against a wall or vertical surface and fastening it in place using screws or other fastening devices (e.g., drywall anchors, fasteners, mounts).

At the lower portion of the board holder 10 and protruding from the front of the base 30 is a wheel holder 40 with a wheel guide 42. When placing a caster board or skateboard into the board holder 10 to be stored or displayed, the user raises a vertically inclined caster board or skateboard with its wheels facing the board holder 10, and places top wheel(s) 46 into the wheel guide and rolls the wheel(s) 46 up and over the wheel guide 42 and down and into the wheel holder 40. The purpose of the wheel guide 42 is to align and stabilize a caster 44 on the caster board 20, and for both caster boards and skateboards to keep wheel(s) 46 in line to be rolled into the wheel holder 40.

The wheel holder 40 and the wheel guide 42 include generally U-shape cross-section, concave inside surfaces that approximately mate with outside surface(s) of the typical wheel(s) 46 of a caster board or skateboard. The wheel guide 42 and the wheel holder 40 for skateboards will be much wider than that for caster boards as they will need to accommodate two wider wheels 46 instead of one thinner wheel. Alternatively, the wheel guide 42 and the wheel holder 40 for skateboards may include separate, spaced wheel guides 42/wheel holders 40, one for each wheel 46 at one end of the skateboard.

Figure 5:
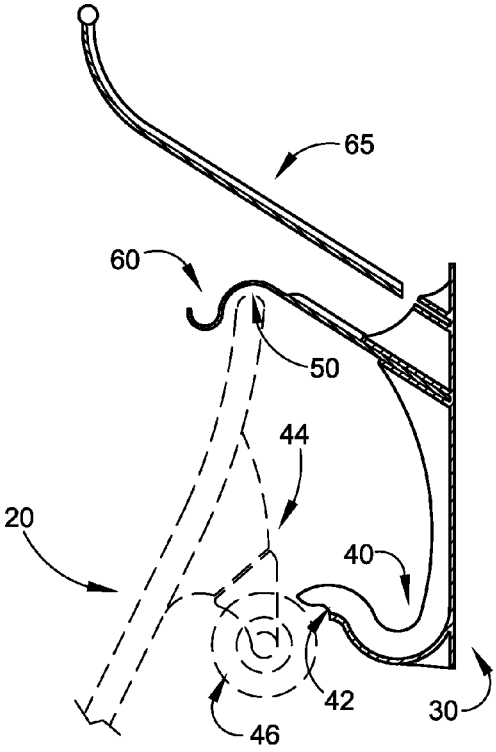
FIGS. 5-8 are side-elevational views of the board holder of FIG. 1 and sequentially depict an exemplary method of mounting a caster board into the board holder.
Figure 6:
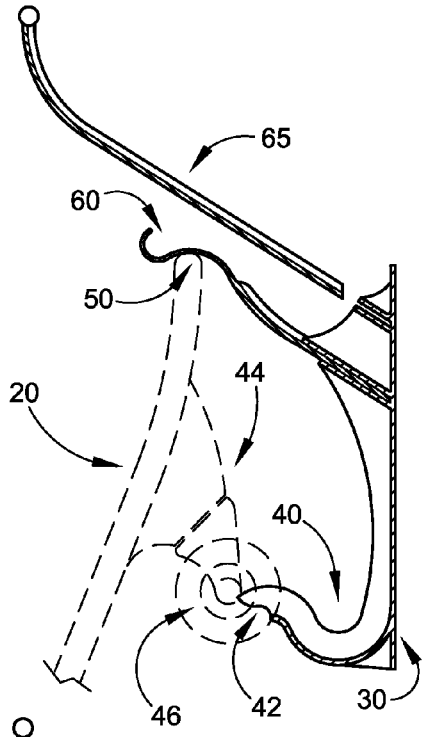
Figure 7:
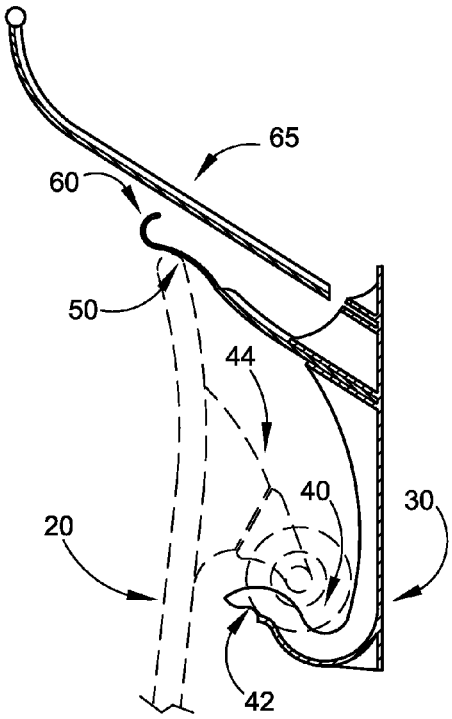
Figure 8:
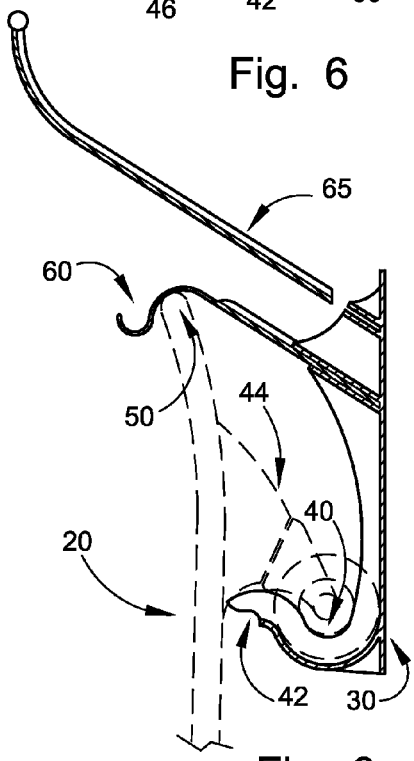

With reference additionally to FIGS. 5-8, at the upper portion of the board holder 10 and protruding from the front of the base 30 is a clasp 50, which is used primarily to hold the top most or upper edge of the caster board 20 or skateboard (typically the front tip of the board) towards the wall or vertical plane, creating an inward (towards wall) and downward force on the upper wheel(s) 46 of the caster board or skateboard towards the wall or other vertical surface (i.e. forcing the weight of the lower part of the board 20 to push and hold the upper wheel(s) 46 firmly into the wheel holder 40 and against the base 30) while at the same time restricting the movement of the lower portion of the caster board or skateboard such that the lower wheel(s) will not come in contact with the wall or other vertical surface.

The clasp 50 is fashioned so that it is flexible enough to allow either the top edge of the board 20 to "snap" or slip into place under and behind the clasp 50 after the upper wheel(s) 46 is settled into the wheel holder 40, or if the top edge of the board 20 is placed behind the clasp 50 first (i.e., first hooking the top edge of the board 20 behind the clasp (on the side of the clasp 50 closest to the vertical surface) and then pushing the lower part of the board 20 towards the vertical surface so as to force the upper wheel(s) 46 into the wheel guide 42 and then up and over into the wheel holder 40 as shown in FIGS. 5-8) then it will be flexible enough to allow the upper wheel(s) 46 to roll up and over the wheel guide 42 and into the wheel holder 40, but is rigid enough to hold the top edge of the caster board or skateboard at a certain distance from the wall or vertical surface while the hanging weight of the caster board or skateboard creates torque around the top wheel(s) 46 placing both outward pressure on the clasp 50 from the top edge of the caster board or skateboard, and inward pressure on the base 30 and wheel holder 40 from the top wheel(s) of the caster board or skateboard. These opposing forces work together such that the lower portion and wheel(s) of the caster board or skateboard are held away from the wall or other vertical surface.

Torque is created around the upper wheel(s) 46 (with the wheel holder 40 being the point of axis) as the clasp 50 holds the top edge from rotating further away from the vertical surface, and the hanging weight of the board 20 takes advantage of gravitational forces to continuously pressure the upper wheel(s) 46 into the wheel guide 42.

The holder 10 can also include and/or the clasp 50 can also be fashioned so that beyond the portion of the clasp 50 that is intended to hold a caster board or skateboard in place, the clasp 50 can continue to protrude from the base 30 to form a hook/carrier 60 that will allow the user to hang a riding helmet or other related accessories from the end of the clasp 50. The weight of the accessories on the carrier 60 will only add to the holding force of the clasp 50.

The board holder 10 includes a separate helmet/accessory carrier 65. This helmet/accessory carrier 65 protrudes separately from the front of the base 30 from the upper most portion of the device, above the clasp 50, so that a user can conveniently hang their helmet and/or other related accessories above their caster board 20 and store and/or display them without impairing the view of their caster board or skateboard.

In another embodiment of the board holder 10, the wheel holder 40 and wheel guide 42 are adjustable and can be adjusted vertically higher or lower on the base 30 (and/or the width of the wheel holder 40/wheel guide 42 are adjustable and/or replaceable for different-sized wheels). Also, the clasp 50 of the board holder 10 can be adjusted and/or replaced so that the clasp 50 can be closer or farther away from the base 30 and vertically higher or lower on the base 30. These adjustments will allow for one board holder 10 to be used on a variety of board types and sizes as each brand of caster board and skateboard may have different dimensions and angles relative to the special relationship between the front wheel 46 and the top edge of the front of the board.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in any claims that may follow, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

Still further, the terms "upper" and "lower" are only appropriate to the extent that the board 20 is held vertically (as though it were about to be mounted into the holder 10). Accordingly, the front part of the board 20 (when the board 20 is horizontal) may be the "upper" part of the board if the front part of the board 20 is vertically above the rear part of the board 20 (when board 20 is held vertically). Similarly, the rear part of the board (when the board is horizontal) may be the "upper" part of the board if the rear part of the board 20 is vertically above the front part of the board 20 (when board 20 is held vertically).

The invention claimed is:

1. A wheeled sports board holder for hanging a wheeled sports board on a vertical surface, the wheeled sports board including a support deck with an upper portion supported by one or more upper wheels, and having an upper edge, and a lower portion supported by one or more lower wheels, the wheeled sports board holder comprising:

a base with a front and a rear, the rear of the base mountable to the vertical surface;

a wheel holder projecting forwardly relative to the front of the base, and having a wheel guide;

a clasp projecting forwardly relative to the front of the base, past and above the wheel holder, the clasp being longer in length than the wheel holder and configured to hold the upper edge of the wheeled sports board towards the vertical surface so that the one or more lower wheels do not contact the vertical surface.

2. The wheeled sports board holder of claim 1, wherein the wheeled sports board is a caster board.

3. The wheeled sports board holder of claim 1, wherein the wheeled sports board is a skateboard.

4. The wheeled sports board holder of claim 1, wherein the wheeled sports board is a scooter.

5. The wheeled sports board holder of claim 1, wherein the wheeled sports board holder is a single storage and display device for the wheeled sports board.

6. The wheeled sports board holder of claim 1, wherein the wheeled sports board holder is an in-store product display.

7. The wheeled sports board holder of claim 1, further including an accessory carrier projecting forwardly relative to the front of the base and configured to carry one or more accessories associated with the wheeled sports board.

8. The wheeled sports board holder of claim 1, wherein the clasp includes an accessory carrier configured to carry one or more accessories associated with the wheeled sports board.

9. The wheeled sports board holder of claim 1, wherein at least one of the wheel holder and the clasp are adjustable to accommodate at least one of different types of wheeled sports boards and different sizes of wheeled sports boards.

10. The wheeled sports board holder of claim 1, wherein the wheel guide includes a U-shape cross-section and concave inside surfaces that matingly receive the one or more upper wheels.

11. A method of using the wheeled sports board holder of claim 1, comprising:

raising a vertically inclined wheeled sport board with its one or more upper wheels and one or more lower wheels facing the wheeled sports board holder;

placing the one or more upper wheels into the wheel guide and rolling the one or more upper wheels up and over the wheel guide and down and into the wheel holder;

snapping the clasp over the upper edge of the wheeled sports board to secure the upper portion of the wheeled sports board into the wheeled sports board holder so that the one or more lower wheels do not contact the vertical surface.

12. The method of claim 11, wherein the support deck of the wheeled sports board includes a substantially flat section, and snapping includes snapping the clasp over the upper edge of the wheeled sports board holder, securing the wheeled sports board in a position where the substantially flat section of the support deck is substantially parallel with the vertical surface.

13. The method of claim 11, wherein the support deck includes a top surface that includes artwork, and snapping includes snapping the clasp over the upper edge of the wheeled sports board holder, holding the wheeled sports board so that the artwork of the top surface of the support deck faces away from the vertical surface, so that the top surface is displayed as a work of art.

14. A method of using the wheeled sports board holder of claim 1, comprising:

raising a vertically inclined wheeled sport board with its one or more upper wheels and one or more lower wheels facing the wheeled sports board holder;

hooking the upper edge of the board behind the clasp;

pushing the lower portion of the wheeled sports board towards the vertical surface so as to force the one or more upper wheels into the wheel guide and then up and over into the wheel holder so as to secure the upper portion of the wheeled sports board into the wheeled sports board holder so that the one or more lower wheels do not contact the vertical surface.

15. The method of claim 14, wherein the support deck of the wheeled sports board includes a substantially flat section, and further including securing the wheeled sports board in a position where the substantially flat section of the support deck is substantially parallel with the vertical surface.

16. The method of claim 14, wherein the support deck includes a top surface that includes artwork, and further including securing the wheeled sports board so that the artwork of the top surface of the support deck faces away from the vertical surface, so that the top surface is displayed as a work of art.

* * * * *